US008262089B1

(12) United States Patent
Chng et al.

(10) Patent No.: US 8,262,089 B1
(45) Date of Patent: Sep. 11, 2012

(54) DEPINCHING MECHANISM FOR PAPER JAM REMOVAL IN PRINTER

(75) Inventors: Chow-Jin Chng, Singapore (SG); Foo-Yin Theng, Singapore (SG); Cher-Lek Toh, Singapore (SG)

(73) Assignees: Cal-Comp Precision (Singapore) Limited, Singapore (SG); Cal-Comp Electronics & Communications Company Limited, New Taipei (TW)

( * ) Notice: Subject to any disclaimer, the term of this patent is extended or adjusted under 35 U.S.C. 154(b) by 0 days.

(21) Appl. No.: 13/104,032

(22) Filed: May 10, 2011

(30) Foreign Application Priority Data

Mar. 31, 2011 (SG) ..... 201102300-9

(51) Int. Cl.
*B65H 5/02* (2006.01)

(52) U.S. Cl. ..... 271/274; 271/273; 271/117

(58) Field of Classification Search ..... 271/274, 271/273, 117
See application file for complete search history.

(56) References Cited

FOREIGN PATENT DOCUMENTS

JP 63066035 A * 3/1988

* cited by examiner

*Primary Examiner* — Luis A Gonzalez
(74) *Attorney, Agent, or Firm* — Jianq Chyun IP Office

(57) ABSTRACT

A depinching mechanism including a frame, a star wheel assembly, a transmitting device and a sensor is provided in present invention. Through the transmitting device rotating reversely, the star wheel assembly is lifted to the second position when paper jam occurs, thus depinched the media so that user can clear the paper jam. After that the star wheel assembly is lowered to the first position again. The star wheel assembly remains in the first position in normal printing process. Using a one-way clutch and a cam with an outer predetermined profile, the transmitting device rotates forwardly without transmitting any torque during normal printing process, and rotates inversely with transmitting a torque to lift the star wheel assembly up and lower the star wheel assembly down when paper jam occurs. Thus, the depinching mechanism can be used in printers to auto fix the paper jamming problems.

8 Claims, 6 Drawing Sheets

DEPINCHING MECHANISM FOR PAPER JAM REMOVAL IN PRINTER

CROSS-REFERENCE TO RELATED APPLICATION

This application claims the priority benefit of Singapore application serial no. 201102300-9, filed on Mar. 31, 2011. The entirety of the above-mentioned patent application is hereby incorporated by reference herein and made a part of this specification.

BACKGROUND OF THE INVENTION

1. Field of the Invention

The present invention generally relates to printers and more particularly to depinching mechanism for paper jam removal in printers.

2. Description of Related Art

Along with the widespread of information products, various information products are developed, and the information products have a general trend of diversity. However, regarding image display methods of a computer, displays and printers are mainly used as image output devices. Wherein, the printers can be approximately categorized into three types of point matrix printers, inkjet printers and laser printers. Taking the laser printer as an example, it has advantages of high printing quality, fast printing speed, and low average cost of consumables, etc., so that the laser printer is one of the popular printers in the market.

However, during a paper picking process of the printer, a phenomenon of paper skew or paper jam is occurred due to a mechanical structure of the printer and differences of paper properties. It is rather inconvenient and time consuming that paper jam occurs during printing or receiving a fax. Usually paper jams when the transferring paper is clamped by the fixing roller and the pressure roller. To correct the problem of paper skew, a paper feeding device of the printer may perform actions to adjust the paper, by which the paper is repeatedly slid to adjust a position thereof or a mechanical structure is used to mitigate the problem of paper skew or paper jam. Generally in this condition, it is necessary to remove the jammed paper by manually from the printer or the fax machine. For removing the jammed paper the cover of the printer or the fax machine has to be opened and the user has to pull out the jammed paper carefully. Hands may also get dirty to remove the jammed paper. The present invention is directed to solve the encountering problem described above with a very simple mechanism and low manufacturing cost.

SUMMARY OF THE INVENTION

Accordingly, the present invention is directed to a depinching mechanism which can fix the case of paper jam in a printer automatically.

The present invention provides a depinching mechanism including a frame, a star wheel assembly, a transmitting device, and a sensor. The depinching mechanism is adapted to be used in a printer to automatically depinch the media and allow user to remove the paper jam. The star wheel assembly is located upon the frame. The transmitting device is disposed on the frame and located below the star wheel assembly. The transmitting device includes a shaft, a clutch, a rotating element, a cam and a plunger. The shaft is rotatably fixed to the frame. The clutch is fixed and sleeves to the shaft. The rotating element is coupled to the clutch. The cam is located between the frame and the rotating element, wherein the shaft is coupled to the cam. The plunger is movably disposed on the frame and located between the cam and the star wheel assembly with one end freely attached to the cam and another end freely attached to the star wheel assembly. The sensor is disposed on the frame and located between the star wheel assembly and the transmitting device. In which the star wheel assembly is lifted to a second position and lowered to a first position when the transmitting device is in a working status, and the star wheel assembly remains in the first position when the transmitting device is in an idle status.

According to an embodiment of the present invention, wherein the transmitting device in the working status rotates in opposite direction relative to the transmitting device in the idle status.

According to an embodiment of the present invention, wherein the depinching mechanism further includes a driving unit to drive the transmitting device, and the transmitting device is coupled to the driving unit.

According to an embodiment of the present invention, wherein a portion of the shaft is a double-D shaft so as to couple to the cam.

According to an embodiment of the present invention, wherein the clutch is a one-way slip clutch.

According to an embodiment of the present invention, wherein the rotating element is a gear.

According to an embodiment of the present invention, wherein the cam has an inner race and an outer race, and the outer race of the cam is in a predetermined profile, and the inner race of the cam is in a double-D feature so as to be coupled with the shaft.

According to an embodiment of the present invention, wherein the star wheel assembly is adapted to carry printing papers.

In view of the above, according to the embodiments of the present invention, through the transmitting device rotating reversely, the star wheel assembly is lifted to the second position when paper jam occurs thus depinched the media so that user can clear the paper jam. After that the star wheel assembly is lowered to the first position again. The star wheel assembly remains in the first position in normal printing process. And thus, the depinching mechanism can auto depinch the printer when paper jam occurs.

In order to make the above features and advantages of the present invention comprehensible, embodiments are described in detail below with the accompanying drawings.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
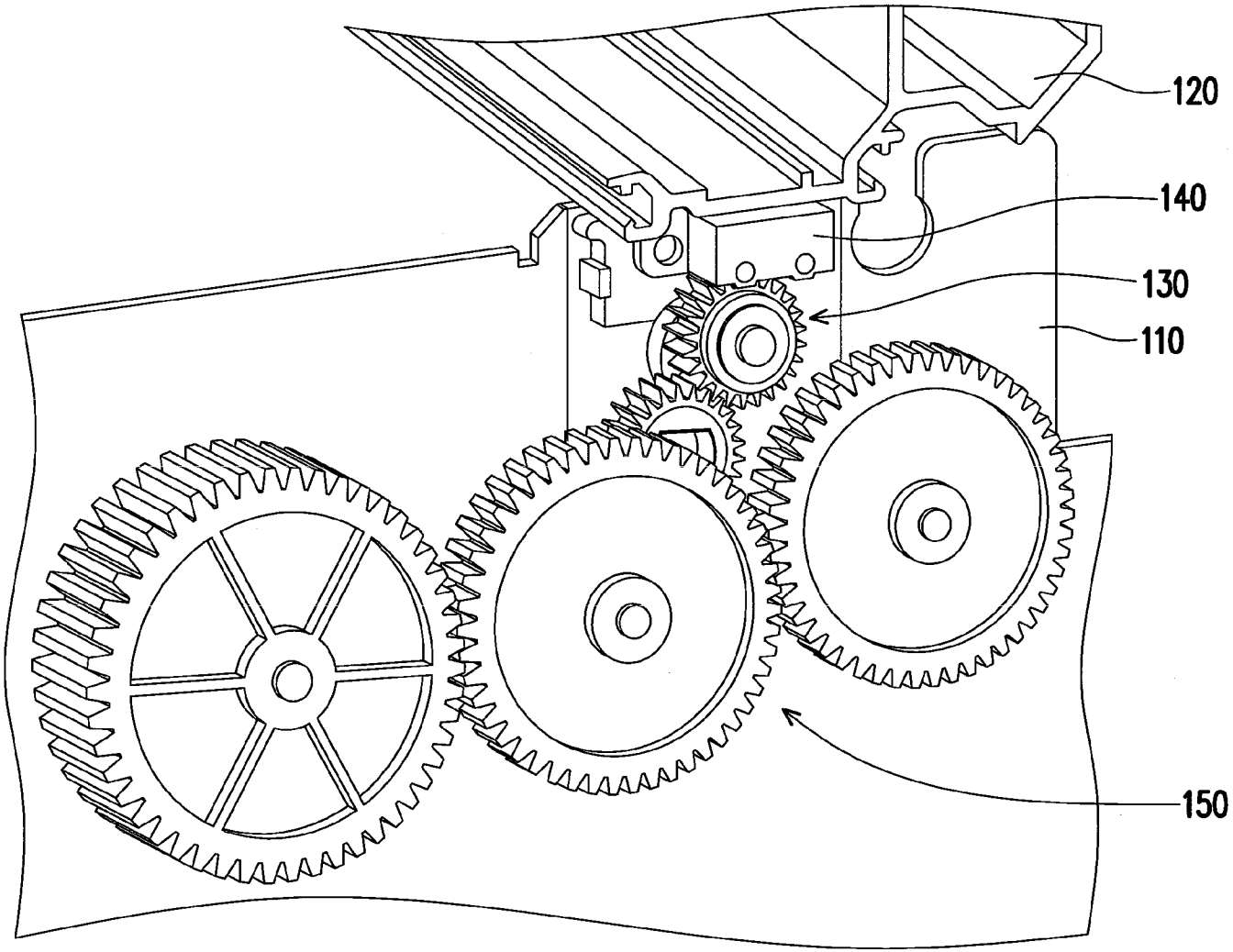
FIG. 1 illustrates a depinching mechanism according to an embodiment of present invention.

Reference will now be made in detail to the present preferred embodiments of the invention, examples of which are illustrated in the accompanying drawings. Wherever possible, the same reference numbers are used in the drawings and the description to refer to the same or like parts.

The figures are not drawn to scale and they are provided merely to illustrate the present invention. Several aspects of the invention are described below with reference to example applications for illustration. It should be understood that numerous specific details, relationships and methods are set forth to provide a full understanding of the invention. The present invention may be embodied in many different forms and should not be construed as limited to the embodiments set forth herein. For example, the present invention can be embodied as a method or a system.

The present invention provides a depinching mechanism with a simple mechanism and low manufacturing cost in order to solve the encountering problem of paper jam in printers, in which the depinching mechanism can auto fix the printer when paper jam occurs. The depinching mechanism uses a transmitting device to solve the paper jamming problem. FIG. 1 illustrates a depinching mechanism according to an embodiment of present invention. Referring to FIG. 1, the depinching mechanism includes a frame 110, a star wheel assembly 120, a transmitting device 130 and a sensor 140. In the embodiment, the star wheel assembly 120 is located upon the frame 110. The star wheel assembly 120 is to carry printing papers in the printer. The transmitting device 130 is disposed on the frame 110 and located below the star wheel assembly 120. The sensor 140 is disposed on the frame 110 and located between the star wheel assembly 120 and the transmitting device 130.

Figure 2A:
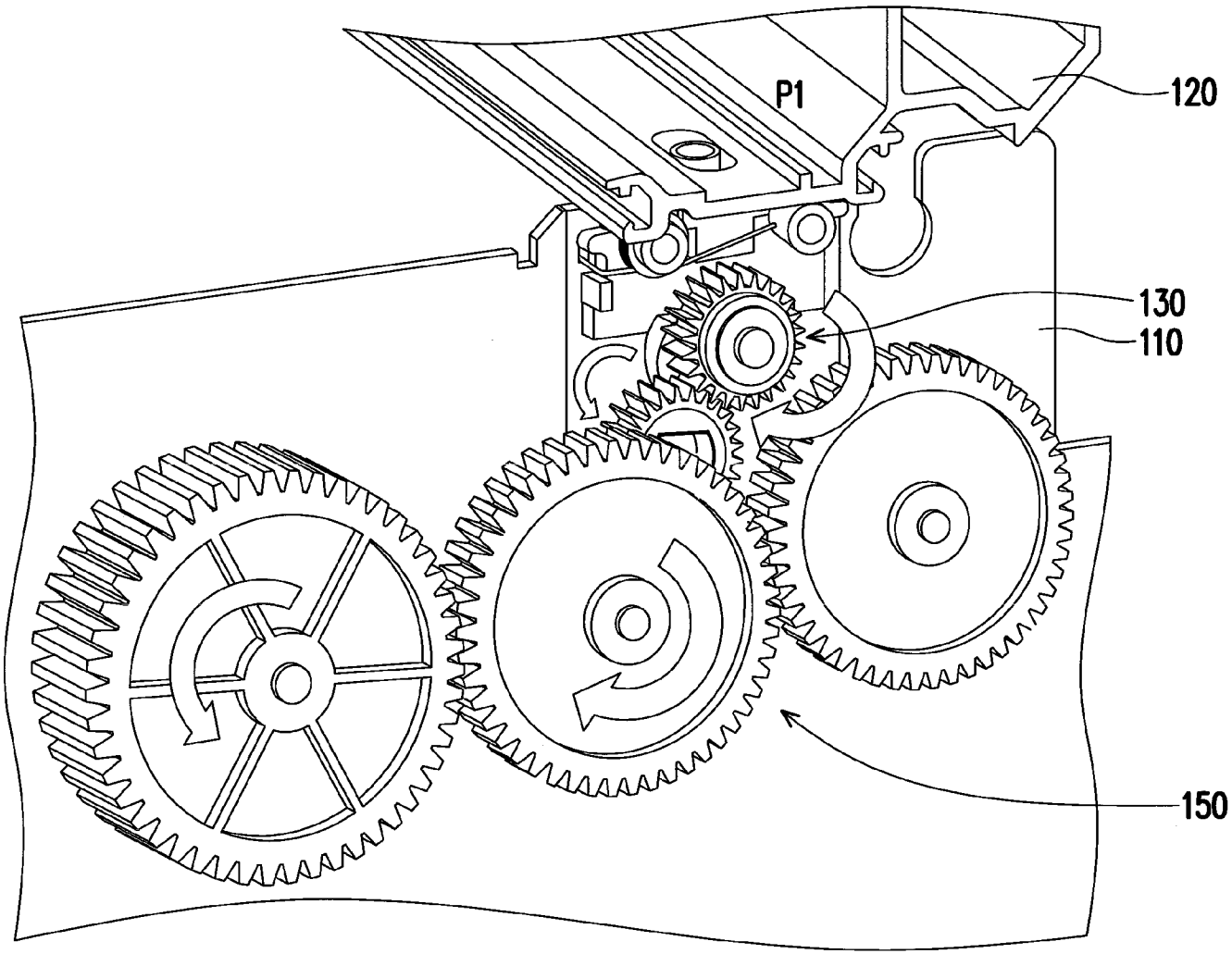
FIGS. 2A, 2B and 2C respectively illustrate the transmitting device of the depinching mechanism in FIG. 1 rotates in the forward direction while the star wheel assembly is in the first position during normal printing process, the transmitting device rotates in a reverse direction and the star wheel assembly is lifted to the second position during paper jamming allowing user to remove the jammed media, and the transmitting device further rotates in a reverse direction and the star wheel assembly is lowered to the first position after the jam is cleared.
Figure 2B:
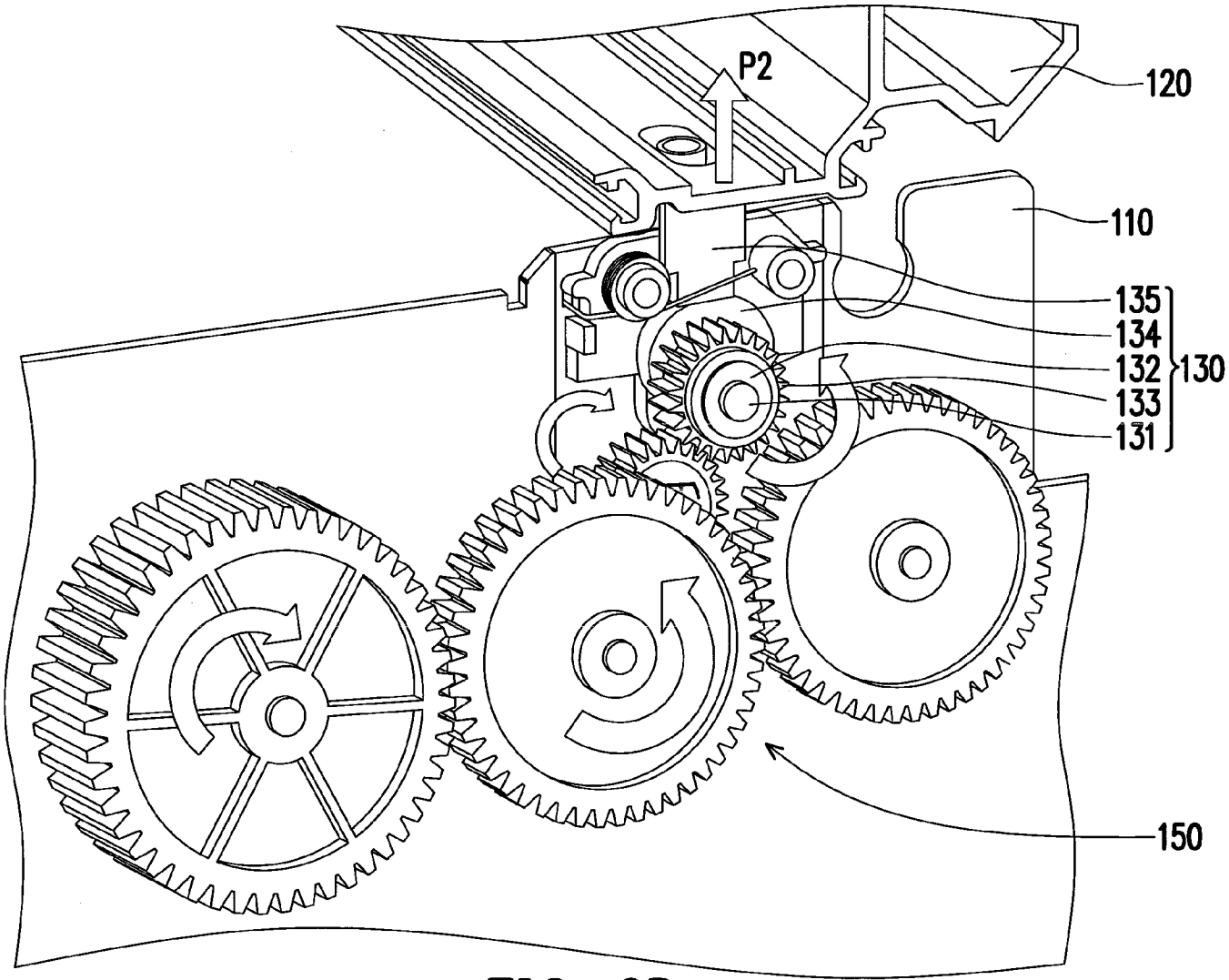
Figure 2C:
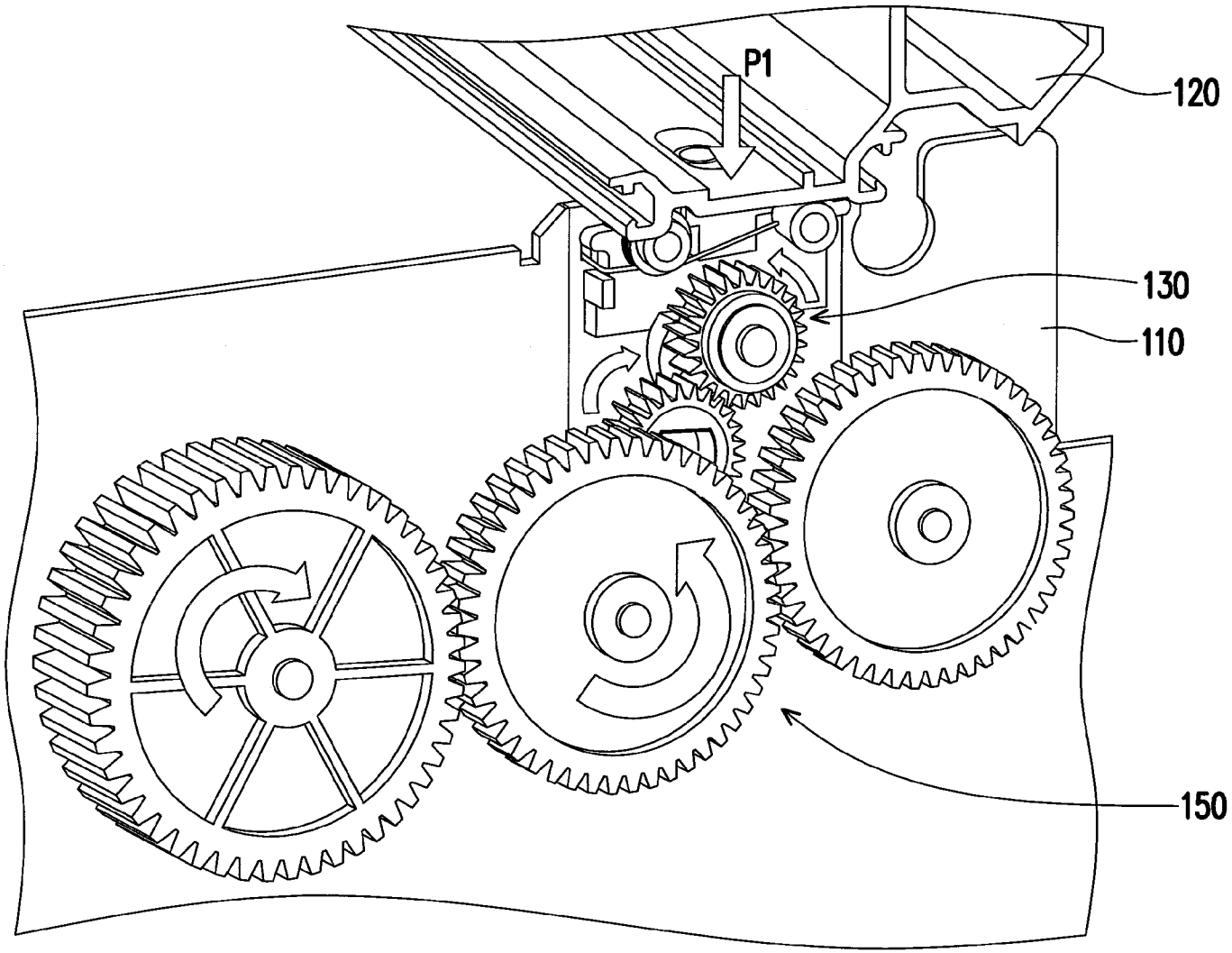

FIGS. 2A, 2B and 2C respectively illustrate the transmitting device of the depinching mechanism in FIG. 1 rotates in the forward direction while the star wheel assembly is in the first position during normal printing process, the transmitting device rotates in a reverse direction and the star wheel assembly is lifted to the second position during paper jamming allowing user to remove the jammed media, and the transmitting device further rotates in a reverse direction and the star wheel assembly is lowered to the first position after the jam is cleared. Please refer to FIGS. 2A, 2B and 2C. In FIG. 2A, the transmitting device 130 is in an idle status and rotates in a forward direction without transmitting any torque during the normal printing process. And at the meanwhile, the star wheel assembly 120 is in a first position P1. In FIG. 2B, when paper jam occurs, the transmitting device 130 is in a working status and rotates in a reverse direction with transmitting a torque to lift the star wheel assembly 120 to a second position P2. And at the meanwhile, the star wheel assembly 120 is lifted to move from the first position P1 to the second position P2. In FIG. 2C, the transmitting device 130 further rotates in the reverse direction with a transmitting torque to lower the star wheel assembly 120 to the first position P1. And at the meanwhile, the star wheel assembly 120 is lowered to move from the second position P2 to the first position P1. And the transmitting device 130 is again in the idle status and rotates in the forward direction without transmitting any torque after the paper jamming problem is fixed. In other words, the rotating directions of the transmitting device 130 in the idle status and the working status are opposite. The star wheel assembly 120 is not allowed to be lifted up to the second position P2 during normal printing process and the transmitting device 130 is able to rotate backwards when paper jam occurs.

Figure 3:
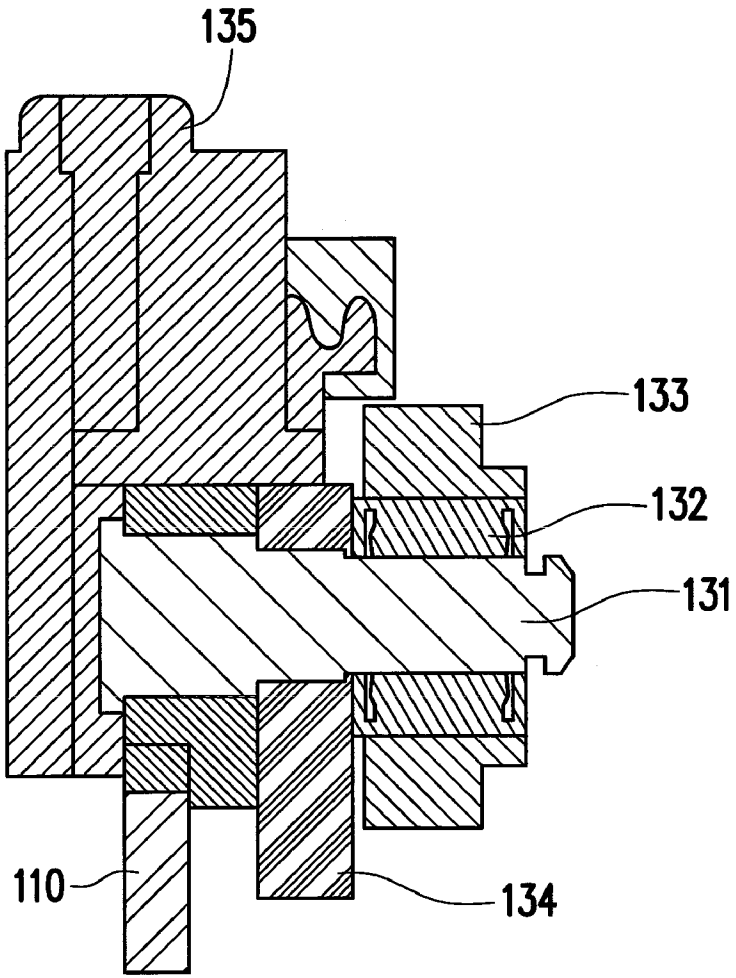
FIG. 3 schematically illustrates a cross section view of the transmitting device of the depinching mechanism in FIG. 1.

FIG. 3 schematically illustrates a cross section view of the transmitting device of the depinching mechanism in FIG. 1. Please refer to FIGS. 2A to 2C and FIG. 3. The transmitting device 130 includes a shaft 131, a clutch 132, a rotating element 133, a cam 134 and a plunger 135. The shaft 131 is rotatably fixed to the frame 110. The shaft 131 acts as an intermediate transmission shaft to couple the cam 134 and the rotating element 133 during the rotating element 133 rotates in the reverse direction when paper jams occurs. In the embodiment, the shaft 131 is in a double-D feature at a portion where the shaft 131 is coupled to the cam 134 in order to enhance the stability of transmitting function. In other embodiments, the shaft can have any suitable feature to couple to the cam and it is not limited in present invention.

The clutch 132 is fixed and sleeves to the shaft 131. The clutch 132 is coupled to the rotating element 133. The clutch 132 is adapted to let the rotating element 133 transfer a rotational movement to the shaft 131 only in one direction. In the embodiment, since a one-way slip clutch is used, the rotation of the outer race of the clutch 132 is transmitted to the inner race in one direction only. It means that the shaft 131 rotates when the rotating element 133 rotates in the reverse direction only.

In the embodiment, the rotating element 133 is a spur gear and the inner race of the spur gear is pressfitted with the outer race of the clutch 132. In other embodiments any rotating device can be used to couple with the clutch 132. The present invention is not limited thereto.

The cam 134 is located between the frame 110 and the rotating element 133. The shaft 131 is coupled to the cam 134. The cam 134 has a predetermined profile on the outer race. In the embodiment, in order to ensure the stability and enhance the transmitting torque by the rotating element 133, the inner race of the cam 134 is in the feature of "double-D" in this embodiment. And the double-D feature of the inner race of the cam 134 is fit to the portion of the shaft 131 with the double-D feature. In other embodiments, the feature of the inner race of the cam 134 can be in any suitable feature, and the present invention is not limited thereto.

In addition, the cam 134 has a predetermined profile on the outer race to push the plunger 135. The plunger 135 is movably disposed on the frame 110 and located between the cam 134 and the star wheel assembly 120 with one end freely attached to the cam 134 and the other end freely attached to the star wheel assembly 120. The star wheel assembly 120 is lifted or lowered correspondingly via the predetermined profile of the cam 134.

In the embodiment, as shown in FIG. 2B, when paper jam occurs and the plunger 135 is pushed by the cam 134 to lift the star wheel assembly 120 up to the second position P2 as the cam 134 rotates from 0~180 degree. As shown in FIG. 2C, as the cam 134 keeps rotating from 180~360 degree, the plunger 135 is lowered together with the star wheel assembly 120 to the first position P1. As shown in FIG. 2A, the cam 134 is not transmitted any torque or load and thus the star wheel assembly 120 keeps staying in the first position P1 during the normal printing process. The outer predetermined profile of the cam 134 can be designed according to the desired distance which the star wheel assembly 120 has to be lifted up.

In this way, as shown in FIG. 2B, when paper jam occurs, the rotating element 133 rotates in the reverse direction and transmits a torque to the shaft 131 via the clutch 132, and the shaft 131 drives the cam 134, and the cam 134 pushes the plunger 135, and the plunger 135 lifts the star wheel assembly 120 to the second position P2. And then as shown in FIG. 2C, the rotating element 133 keeps rotating in the reverse direction and transmits a torque to the shaft 131 via the clutch 132, and the shaft 131 further drives the cam 134, and the plunger 135 and the star wheel assembly 120 are lowered to the first position P1 because of the reducing outer diameter of the outer profile of the cam 134. As shown in FIG. 2A, in normal printing status, the rotating element 133 rotates in the forward direction without transmitting any torque to the shaft 131 and is in the idle status, and thus the star wheel assembly 120 keeps staying in the first position P1.

In the embodiment, the depinching mechanism further includes a driving unit 150 to drive the transmitting device 130. The transmitting device 130 is coupled to the driving unit 150. The driving unit 150 is driven by a motor. There is usually a driving unit to drive the paper feeding roller in printers. The transmitting device 130 can be driven by the same driving unit 150 in this embodiment. In other embodiments, the transmitting device 130 can be driven by any other driving unit and the present invention is not limited thereto.

Figure 4:
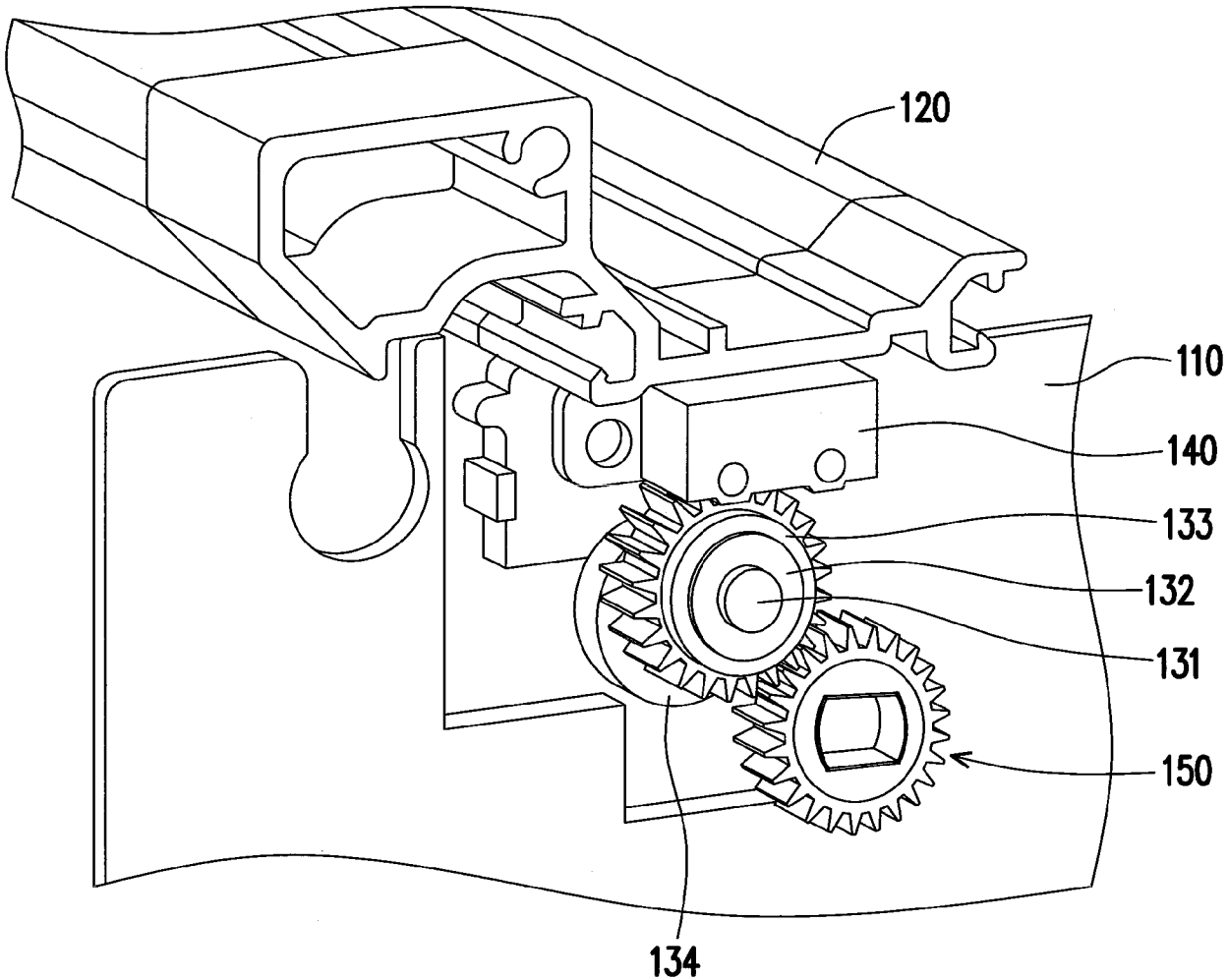
FIG. 4 schematically illustrates an enlarged portion of the depinching mechanism in FIG. 1.

FIG. 4 schematically illustrates an enlarged portion of the depinching mechanism in FIG. 1. Referring to FIG. 4, the sensor 140 is disposed on the frame 110 and located between the star wheel assembly 120 and the transmitting device 130. In the embodiment, the sensor 140 is required to detect the status or the position of the star wheel assembly 120. For example if the star wheel assembly 120 has to be lifted up, the sensor 140 will tell whether the star wheel assembly 120 is in its lowered position (the first position P1) or not, if yes then the motor will rotate X number of encoder counts to lift the star wheel assembly 120 up, if not the motor will rotate till the sensor 140 is triggered and then subsequently rotate X number of encoder counts to lift the star wheel assembly 120 up. In other words, the function of the sensor 140 is to zero the position of the star wheel assembly 120 when paper jam occurs and the transmitting device 130 starts to rotate in the reverse direction. Such configuration has the advantage of ensuring the position of the star wheel assembly 120.

In summary, according to the embodiments of the present invention, through the transmitting device rotating reversely, the star wheel assembly is lifted from the first position to the second position, and lowered from the second position to the first position when paper jam occurs, and the star wheel assembly remains in the first position in normal printing process. Using a one-way clutch and a cam with an outer predetermined profile, the transmitting device rotates forwardly without transmitting any torque during normal printing process, and rotates inversely with transmitting a torque to lift the star wheel assembly up and lower the star wheel assembly down when paper jam occurs. And thus, the depinching mechanism of present invention can be used in printers to auto fix the paper jam problems.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope, of the following claims and their equivalents.

What is claimed is:

1. A depinching mechanism, for paper jam removal in printer, comprising:

a frame;

a star wheel assembly, located upon the frame;

a transmitting device, disposed on the frame and located below the star wheel assembly, comprising:

a shaft, rotatably fixed to the frame;

a clutch, fixed and sleeving to the shaft;

a rotating element, coupled to the clutch;

a cam, located between the frame and the rotating element, wherein the shaft is coupled to the cam; and a plunger, movably disposed on the frame and located between the cam and the star wheel assembly with one end freely attached to the cam and another end freely attached to the star wheel assembly; and a sensor, disposed on the frame and located between the star wheel assembly and the transmitting device;

wherein the star wheel assembly is lifted to a second position and lowered to a first position when the transmitting device is in a working status, and the star wheel assembly remains in the first position when the transmitting device is in an idle status.

2. The depinching mechanism according to claim 1, wherein the transmitting device in the working status rotates in opposite direction relative to the transmitting device in the idle status.

3. The depinching mechanism according to claim 1, further comprising a driving unit to drive the transmitting device, wherein the transmitting device is coupled to the driving unit.

4. The depinching mechanism according to claim 1, wherein a portion of the shaft is a double-D shaft so as to couple to the cam.

5. The depinching mechanism according to claim 1, wherein the clutch is a one-way slip clutch.

6. The depinching mechanism according to claim 1, wherein the rotating element is a gear.

7. The depinching mechanism according to claim 1, wherein the cam has an inner race and an outer race, and the outer race of the cam is in a predetermined profile, and the inner race of the cam is in a double-D feature so as to be coupled with the shaft.

8. The depinching mechanism according to claim 1, wherein the star wheel assembly is adapted to carry printing papers.

* * * * *